United States Patent [19]

Smith

[11] Patent Number: 4,821,624

[45] Date of Patent: Apr. 18, 1989

[54] STROKE LIMITER FOR HYDRAULIC CYLINDER

[75] Inventor: James R. Smith, LaMotte, Iowa

[73] Assignee: Deere & Company, Moline, Ill.

[21] Appl. No.: 161,868

[22] Filed: Feb. 29, 1988

[51] Int. Cl.[4] ..... F15B 15/22

[52] U.S. Cl. ..... 91/401; 91/422; 92/13.4; 92/13.41; 92/13.6; 92/181 P

[58] Field of Search ..... 91/49, 54, 51, 400, 91/401, 422, 222; 92/13.4, 13.41, 13.5, 13.6, 13.7, 13.8, 51, 181 R, 181 P

[56] References Cited

U.S. PATENT DOCUMENTS

| | | | |
|---|---|---|---|
| 738,546 | 0/1903 | Keller | 92/13.4 |
| 1,117,729 | 11/1914 | Ward | 92/13.4 |
| 2,299,211 | 10/1942 | Clench | 92/13.8 |
| 2,311,816 | 2/1943 | Collins | 92/13.8 |
| 3,338,552 | 8/1967 | Persicke | 92/181 R |
| 3,616,728 | 11/1971 | Kennedy | 92/51 |
| 3,654,834 | 4/1972 | Sifri et al. | 91/422 |
| 3,815,480 | 6/1974 | Spyra | 92/13.8 |
| 3,921,504 | 11/1975 | Mumford et al. | 92/13.4 |
| 4,077,750 | 3/1978 | Hake | 92/13.8 |
| 4,442,754 | 4/1984 | Jezbera | 92/13.3 |
| 4,469,014 | 9/1984 | Nelson | 92/13.6 |
| 4,651,906 | 3/1987 | Hoffmann et al. | 92/13.7 |
| 4,679,989 | 7/1987 | Harriman et al. | 92/13.41 |

FOREIGN PATENT DOCUMENTS

| | | | |
|---|---|---|---|
| 7320196 | 12/1974 | France | 92/13.6 |

*Primary Examiner*—Robert E. Garrett
*Assistant Examiner*—Thomas Denion

[57] ABSTRACT

A stroke limiter for a hydraulic cylinder comprises two sleeve portions each having a channel located therein that are frictionally mounted to the piston rod adjacent to the piston. An elongated contactor is slidably received in each of the channels. The contactor is longer than the sleeve portion and extends past the bottom of the sleeve. The top of the sleeve is provided with a cutout portion which is adjacent to the contactor and provides a hydraulic fluid flow path from the piston mounted poppet valves. When the contactor contacts the end cap of the cylinder, the contactor slides upwardly in the sleeve and contacts the poppet valves in the cylinder unseating the valves and creating a hydraulic fluid flow path across the piston.

15 Claims, 2 Drawing Sheets

STROKE LIMITER FOR HYDRAULIC CYLINDER

BACKGROUND OF THE INVENTION

1. Field of the Invention

The present invention is directed to a stroke limiter for limiting the stroke of a hydraulic piston by automatically opening the poppet valves located in the piston when the piston has reached its maximum desired stroke.

2. Description of the Prior Art

Large industrial machines such as crawlers are provided with hydraulic cylinders for manipulating a work member. A work member such as a dozer blade is coupled to hydraulic cylinders which raise and lower the blade as desired by the operator. The hydraulic cylinders are relatively conventional and comprise a hollow cylinder in which is mounted a piston having a piston rod attached thereto. By applying pressurized hydraulic fluid to either side of the piston, the piston is driven in one direction or another thereby manipulating the work member which is operatively coupled to the piston rod. The piston is provided with spring biased poppet valves. The poppet valves become unseated when they contact the end wall of the cylinder and as such form a hydraulic pressure relief passage across the piston. The poppet valves are provided so that the piston cannot be driven past its maximum design stroke.

To maximize a crawler's operational range, an owner will at times mount different working members or different blades on the crawler. As these working members or blades have somewhat different uses, their working geometry in relation to the crawler is somewhat different. As such, it may be necessary to replace the cylinders so that the stroke of the cylinder more closely matches the working geometry of the new working member.

One method of overcoming the replacement problem, when a shorter stroke cylinder is needed, is to provide a sleeve that can be slidably mounted about the piston rod. As the piston is extended, the sleeve which is in contact with the end wall of the cylinder prematurely contacts the poppet valves effectively producing a shorter stroke. Some problems associated with the above described sleeves is that they may inadvertently open the poppet valves before the piston has reached the desired stroke because they are free to slide up and down the piston rod. Another problem associated with the sleeves is that the cylinder end cap must be removed from the piston rod before the sleeve can be mounted on the rod.

SUMMARY OF THE INVENTION

The invention comprises a two-piece guide sleeve that is bolted about the piston rod and fixedly mounted thereto. The guide sleeve is not free to slide along the rod, but rather frictionally engages the rod so that it is mounted in a fixed relationship to the piston. Each piece of the sleeve is provided with a channel. Poppet contactors are located in the channels and are free to slide in the channels. The contractor are prevented from becoming dislodged from the channels by a locking protuberance and the limited distance between the sleeve and the piston. The contactors are longer than the sleeve and are driven in their channels towards the poppets when one end contacts the end cap of the cylinder. The contactors transmit a release force from the end cap to the poppets effectively limiting the stroke of the cylinder.

By using relative small contactors in relationship to a sleeve, the inertial mass of the contacting member is less, thereby reducing the chance of inadvertent opening of the poppet valves. Within a limited range, contactors of various lengths can be employed for different strokes with the same sleeve. The contactors can also be manufactured from relatively inexpensive bar stock. The stroke limiter of the present invention can be readily retrofitted onto a piston rod by removing the end cap of the cylinder from the cylinder and sliding it down the piston rod, thereby simplifying the installation of the unit.

DETAILED DESCRIPTION

Figure 1:
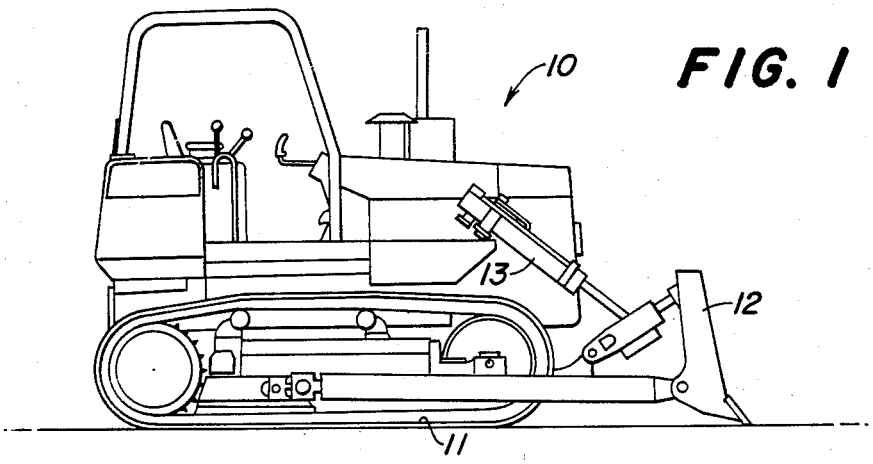
FIG. 1 is a side view of a crawler having a dozer blade and hydraulic cylinders for manipulating the blade.
Figure 2:
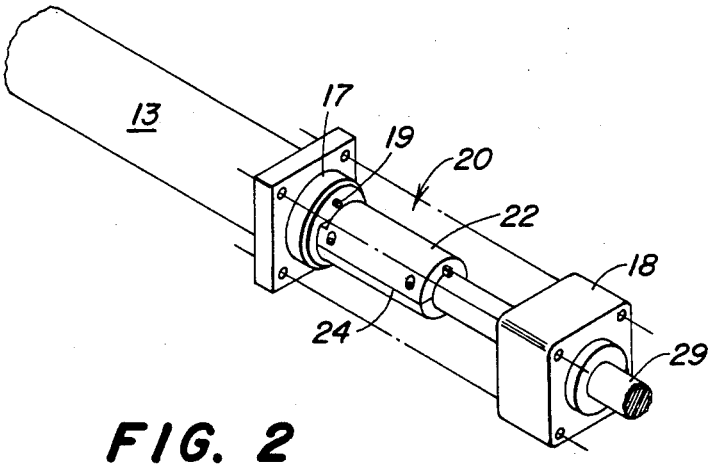
FIG. 2 is a perspective detail view of a hydraulic cylinder with the end cap separated from the cylinder and the stroke limiter attached to the piston rod.
Figure 5:
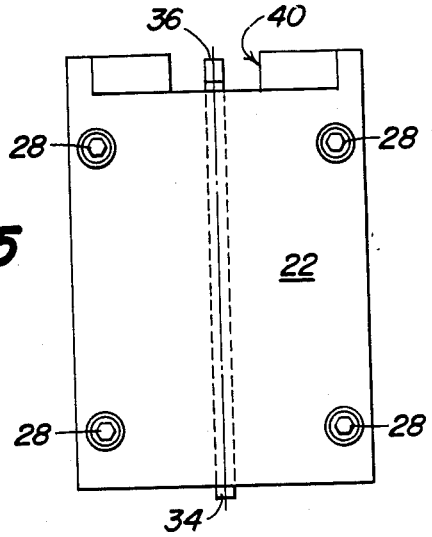
FIG. 5 is a top view of the stroke limiter.
Figure 3:
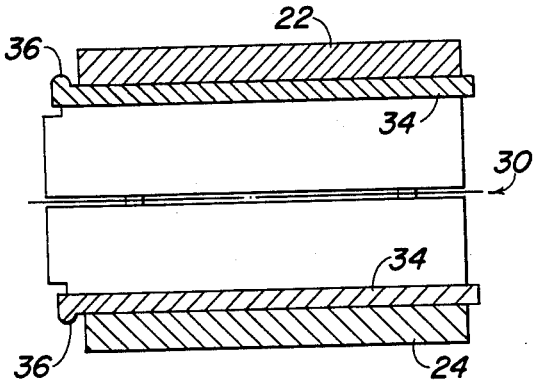
FIG. 3 is a cross sectional side view of the stroke limiter.
Figure 4:
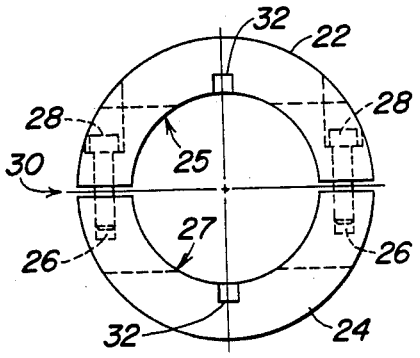
FIG. 4 is an end view of the stroke limiter.

FIG. 1 illustrates a large crawler 10 having tracks 11 which are used to propel the vehicle across rough terrain. The vehicle is provided with a dozer blade 12 which is manipulated up and down by two hydraulic cylinders 13 (only one shown). When a new blade or other implement needs to be attached to the crawler, the working geometry of the machine changes and it is desirable to control the stroke of the hydraulic cylinders. Although this invention is being described as being used with a large crawler, to which it is well suited, the invention can be used in any hydraulic cylinder having piston mounted poppet valves where it is desirable to limit stroke.

Figure 6:
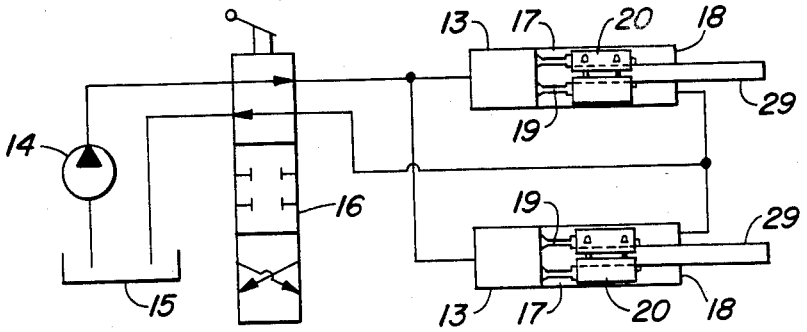
FIG. 6 is a simplified hydraulic circuit illustrating the operation of the poppet valves.

FIG. 6 illustrates a simplified hydraulic circuit for operating hydraulic cylinders 13. A hydraulic pump 14 directs hydraulic fluid from sump 15 through directional control valve 16 to both cylinders. The cylinders are relatively conventional comprising a hollow elongated chamber in which is slidably located piston 17. A piston rod is coupled to the piston and extends outwardly through an aperture in end cap 18. Two spring biased poppet valves 19 are mounted in each piston and form a hydraulic fluid relief path through the piston. The poppet valves are spring biased closed and are provided with an actuator stem that projects outwardly from the piston. Upon the actuator stem contacting stroke limiter 20 the poppet valve becomes unseated forming the hydraulic fluid relief path.

Stroke limiter 20 comprises first and second sleeve portions 22 and 24. Each of the sleeve portions is provided with a mounting assembly comprising threaded apertures 26 into which are received joining members comprising mounting bolts 28. The sleeve halves have arcuate surfaces 25 and 27 for engaging piston rod 29. Spacing 30 is provided between the sleeve halves so that when the halves are bolted together, the halves can be drawn tightly together frictionally mounting the sleeve to the rod. The outer diameter of the combined sleeve and piston rod is less than the inner diameter of the cylinder to allow oil to flow around the limiter.

Each sleeve half is provided with a square channel 32 which extends the length of the sleeve. Contacting means 34 is adapted and constructed to be slidably received in the channel and is free to slide back and forth therein. The contacting means comprises a square steel shaft contactor that is longer than the sleeve. The end of the contactor adjacent to the piston is provided with a protuberance 36. The protuberance may comprise a weld bead and is used to prevent the contactor from sliding free from the sleeve. An operator may use contactors of different lengths to control stroke length. However, because of material characteristics, it is not desirable for the contactor to extend significantly past the sleeve as this may result in bending of the contactor and eventual binding of the contactor preventing its free sliding in the channel.

The top of each sleeve half is provided with a cut out portion 40 that is adjacent to the contactor and provides a radial flow path directing fluid outward from the poppet valve and around the sleeve. Cutout portion 40 also provides room for protuberance 36.

To mount the stroke limiter of the present invention, the piston is first extended and the end cap unbolted. The end cap is moved down the piston rod and the two halves of the sleeve together with the contactors are positioned about the rod adjacent to the piston. The sleeve is circumferentially positioned so that the contactors are adjacent the poppet valves. The halves are then bolted together so that the sleeve frictionally engages the rod. The piston is then withdrawn into the cylinder and the end cap is rebolted to the cylinder.

The invention should not be limited to the above described embodiment or environment, but should be limited solely to the claims that follow.

I claim:

1. A stroke limiter for limiting the piston stroke of a hydraulic cylinder comprising:

a first sleeve portion having a first engaging surface for engaging a piston rod, the first sleeve portion is provided with a first mounting assembly;

a second sleeve portion having a second engaging surface for engaging a piston rod, the second sleeve portion is provided with a second mounting assembly; and at least one joining member for joining the first and second mounting assemblies for coupling the first and second sleeve portions to one another, whereby at least one of the sleeve portions is provided with a channel into which is slidably received a contacting means for contacting a poppet valve located on a piston.

2. A stroke limiter as defined by claim 1 wherein the first and second engaging surfaces are arcuate and frictionally mount the stroke limiter to a piston rod when the first and second sleeve portions are joined together about a piston rod.

3. A stroke limiter as defined by claim 2 wherein the contacting means comprises a contactor that is longer than the sleeve portions and which is provided with a protuberance so as to prevent it from becoming disengaged from the stroke limiter when it is mounted to a piston rod.

4. A stroke limiter as defined by claim 3 wherein the sleeve portion having the channel is provided with a cutout portion adjacent to the channel providing an oil flow path.

5. A hydraulic cylinder comprising:

a hollow elongated chamber defining a volume that can be pressurized by hydraulic fluid;

an end cap for sealing the elongated cylinder, the end cap being provided with an aperture;

a piston located in the elongated cylinder, the piston is adapted and constructed to move within the cylinder in response to differential hydraulic pressure;

at least one poppet valve mounted in the piston and providing a flow path through the piston;

a piston rod coupled to the piston and extending through the aperture in the end cap, the piston rod is coupled to the piston so that it moves together with the piston;

a sleeve frictionally mounted to the piston rod, the sleeve having at least one channel; and a contacting means slidably received in the channel, for contacting and opening the poppet valve when the contacting means is driven towards the poppet valve by the contacting means contacting the end cap.

6. A hydraulic cylinder as defined by claim 5 wherein the contacting means comprises an elongated contactor that is longer than the sleeve.

7. A hydraulic cylinder as defined by claim 6 wherein the sleeve is provided with a top surface abutting the piston.

8. A hydraulic cylinder as defined by claim 7 wherein the sleeve is provided with a cutout portion adjacent to the elongated contactor to provide a hydraulic fluid flow path.

9. A hydraulic cylinder as defined by claim 8 wherein the elongated contactor is provided with a protuberance for preventing the contactor from becoming disengaged from the sleeve.

10. A hydraulic cylinder as defined by claim 9 wherein the sleeve comprises two sleeve portions that are joined together by mounting bolts.

11. A hydraulic cylinder as defined by claim 10 wherein each sleeve portion is provided with an engaging surface for engaging the piston rod.

12. A hydraulic cylinder as defined by claim 11 wherein the engaging surface of each sleeve portion is arcuate.

13. A hydraulic cylinder as defined by claim 12 wherein a space is formed between the sleeve portions after they are mounted on the piston rod.

14. A method of applying a stroke limiter to a hydraulic cylinder comprising the following steps:

extending the piston in the cylinder;

uncoupling the end cap from the cylinder;

applying two sleeve portions having at least one sliding contactor to the piston rod adjacent to the piston;

frictionally mounting the two sleeve portions to the piston rod;

withdrawing the piston back into the cylinder; and recoupling the end cap to the cylinder.

15. The method as defined by claim 14 wherein the step of frictionally applying the two sleeve portions comprises bolting the sleeve portions together.

* * * * *